US005431006A

United States Patent [19]

Schuller et al.

[11] Patent Number: 5,431,006

[45] Date of Patent: Jul. 11, 1995

[54] OPEN-END SPINNING MACHINE

[75] Inventors: Edmund Schuller; Rupert Karl, both of Ingolstadt; Anton Stanglmair, Elsendorf; Gottfried Schneider, Ingolstadt; Hans Landwehrkamp, Lenting; Gerhard Hyna, Ingolstadt; Claus Franz, Wettstetten; Thorsten Büchner, Ingolstadt, all of Germany

[73] Assignee: Rieter Ingolstadt Spinnereimaschinenbau AG, Ingolstadt, Germany

[21] Appl. No.: 122,616

[22] Filed: Sep. 16, 1993

Related U.S. Application Data

[63] Continuation of Ser. No. 906,310, Jun. 29, 1992, abandoned.

[51] Int. Cl.[6] ..... D01H 4/08

[52] U.S. Cl. ..... 57/406; 57/1 R; 57/407

[58] Field of Search ..... 57/406, 407, 1 R

[56] References Cited

U.S. PATENT DOCUMENTS

| | | | |
|---|---|---|---|
| 3,455,097 | 7/1969 | Rajnoha . | |
| 3,511,045 | 5/1970 | Burns et al. | 57/407 |
| 3,774,382 | 11/1973 | Bartling | 57/406 X |
| 3,807,157 | 4/1974 | Stalmlecker | 57/407 X |
| 3,811,256 | 5/1976 | Bystron et al. | 57/1 R |
| 3,859,779 | 1/1975 | Furstenberg | 57/58.89 |
| 3,861,132 | 1/1975 | Stahlecker | 57/58.89 |
| 3,874,154 | 4/1975 | Stahlecker et al. | 57/58.95 |
| 3,884,027 | 5/1975 | Schumann et al. | 57/56 |
| 3,936,995 | 2/1976 | LaFlaquiere et al. | 57/1 R |
| 3,977,168 | 8/1976 | Schewe | 57/406 X |
| 4,030,279 | 3/1977 | Rambousek et al. . | |
| 4,059,947 | 11/1977 | Stahlecker et al. . | |
| 4,060,963 | 12/1977 | Stahlecker et al. | 57/406 X |
| 4,098,065 | 7/1978 | Stahlecker et al. . | |
| 4,122,655 | 10/1978 | Anderson et al. . | |
| 4,125,990 | 11/1978 | Stahlecker et al. . | |
| 4,204,391 | 5/1980 | Clayton et al. | 57/1 R |
| 4,245,460 | 1/1981 | Staufert et al. | 57/58.89 |
| 4,255,925 | 3/1981 | Marzoli . | |
| 4,516,396 | 5/1985 | Stahlecker et al. . | |
| 4,753,067 | 6/1988 | Landwerkamp et al. | 57/407 |
| 4,862,686 | 9/1986 | Stadele et al. | 57/1 R |

FOREIGN PATENT DOCUMENTS 2210210 9/1973 Germany .

OTHER PUBLICATIONS

Pictures and Brochures for RU 14 (no date avl.).

*Primary Examiner*—Daniel P. Stodola
*Assistant Examiner*—William Stryjewski
*Attorney, Agent, or Firm*—Dority & Manning

[57] ABSTRACT

An open-end spinning machine with a machine frame with at least one section. The latter is provided for each longitudinal machine side with a rigid structural unit which consists of several longitudinal structural elements and two end walls. Intermediate walls are provided at least between two adjoining pairs of spinning stations. These intermediate walls are rigidly connected to the longitudinal structural elements as are the intermediate walls, whereby the groups of technological spinning elements, including the parts of drive units and the winding mechanisms are attached to longitudinal structural elements and/or to the intermediate walls. The end walls of the two structural units are connected to each other in pairs.

31 Claims, 6 Drawing Sheets

OPEN-END SPINNING MACHINE

This is a continuation of application Ser. No. 07/906,310 filed Jun. 29, 1992, which was abandoned upon the filling hereof.

BACKGROUND OF THE INVENTION

The instant invention relates to a machine frame for an open-end spinning machine, the machine frame having at least one section. Provided on each longitudinal side of the machine is a plurality of spinning stations adjoining each other, each with a group of technical spinning elements, including at least part of a drive unit therefor and with a winding device. Each section is also provided with end walls at its ends connected to each other by longitudinal structural elements.

It is a known method to provide U-shaped or box-shaped supports extending in the longitudinal direction of the machine and on which the housings of the spinning elements are attached (DE-OS 2 200 686). It has been shown that these supports must be extremely thick to avoid sagging and to ensure that the spinning elements will always assume the desired relative positions in relation to each other even after a longer period of time.

OBJECTS AND SUMMARY OF THE INVENTION

It is a principle object of the instant invention to design the machine frame of an open-end spinning machine in such manner that a change in the relative position of the elements pertaining to spinning is avoided during transportation from the manufacturer to the customer as well as after a long period of operation.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

The objects are attained through the invention in that the section with spinning stations of each longitudinal machine side is provided with a rigid structural unit consisting of several longitudinal structural elements and two end walls and is provided with intermediate walls at least between two adjoining pairs of spinning stations. The intermediate walls are rigidly connected to the longitudinal structural elements as are the end walls, whereby the groups of technical spinning elements, including the part of the drive unit and the winding devices, are attached to the longitudinal structural elements and/or to the intermediate walls and in that two structural units are always interconnected in pairs. The fact that the section of each longitudinal machine side with spinning stations is provided with the rigid structural unit with its connecting intermediate walls and longitudinal structural elements ensures that the technical spinning elements maintain their relative positions in relation to each other within the section. Assembly work after transport to the customer is thus shortened considerably. At the same time, the intermediate walls which are rigidly connected to the longitudinal structural elements ensure the rigidity of this structural unit and permanently fix the relative positions of the longitudinal structural elements in relation to each other.

The connection of the end walls of the two structural units in pairs is preferably established by means of frame walls which extend for this purpose from one longitudinal machine side to the other.

In principle, it suffices for the intermediate walls to be provided between two adjoining pairs of spinning stations, but is has been shown to be especially advantageous for intermediate walls to be provided between the spinning stations of each pair of spinning stations, extending at least over the area with the longitudinal structural elements supporting the winding mechanisms. Preferably however, all the intermediate walls extend beyond the longitudinal structural elements supporting the winding mechanisms, as well as beyond the longitudinal structural elements supporting the group of technical spinning elements and part of the drive unit.

To prevent the drive shafts of the different aggregates of the spinning device from sagging, the intermediate walls may be equipped with bearings in a further advantageous embodiment of the invention to support drive shafts.

In another advantageous embodiment of the device according to the invention, one of the longitudinal structural elements is made in the form of a profiled rail on which one pair of bobbin arms per each spinning station is mounted. The rail is connected to the upper ends of the intermediate walls facing each other of a longitudinal machine side. In this manner these profiled rails with the bobbin arms are included in the reinforcement system of a section.

If one or several of the longitudinal structural elements are made in the form of longitudinal supports for the technological spinning elements and the partial drive unit, it is especially advantageous if the structural elements are made in the form of round supports. In this manner, precise configuration of the longitudinal bearing elements is especially simple and inexpensive since the otherwise normal costly machining of non-round bearing surfaces for the technical spinning elements is omitted.

It has been shown to be advantageous to mount the group of technological spinning elements, including the partial drive, on a common round support in a detachable manner and to secure each of these technological spinning elements against rotation by means of a separate round support for each. The technological spinning elements and the partial drive unit for same are thus all mounted on round supports so that the above-mentioned advantage of simpler and less expensive machining also applies.

It is an advantage for the design of the machine sections to provide not only for sufficient rigidity during production, but also and especially during transport. For this purpose, another advantageous embodiment of the invention provides for each rigid structural element to be fitted out with a tubular longitudinal structural element for the temporary mounting of a .transport axle on each.

In the interest of the easiest and least expensive method of construction of the machine, a further advantageous development of the invention provides for the frame walls connecting rigid structural units of the two longitudinal sides of the machine to each other to be made of sheet metal and be provided with separate reinforcement elements per structural unit. In this manner, and in spite of easier construction, a high degree of rigidity of the section is achieved. It is advantageous in this case to provide for the reinforcement elements to be fitted out with connecting elements which are connected to the legs supporting the section so that the forces exerted as the section is supported do not reach the sheet-metal wall but are absorbed directly by the reinforcement element. It is advantageous in that case for the reinforcement elements on the same end of a section to be interconnected.

To facilitate the alignment of several sections as the point of destination, it is advantageous for the reinforcement elements to be designed so that they serve at the same time as alignment elements. For this purpose, it is possible to provide for one of the longitudinal structural elements to extend through the frame walls and enter an opening of the connected element in the form of a bore between the reinforcement element and the leg, while the longitudinal structural element enters at its other end through a vertical opening of another connecting element that is open at the top.

When a rail system for a service carriage travelling alongside the machine is supported, it is furthermore advantageous to design the reinforcement elements so that they support the rail system. In order to minimize bending moments as much as possible, it is advantageous for the reinforcement elements to be provided with supporting elements constituting the vertical connection between the rail system and the legs.

In order to ensure low-cost shipping from manufacturer to customer, and later rapid assembly of the machine at the customer's location, it is possible to provide in another suitable development of the invention for the reinforcement elements to be provided only on the outside of the frame walls of the sections to be transported and to be assigned later in the assembled machine to an even-numbered location. In this manner, the frame walls of the sections to be positioned at odd numbered locations in the assembled machines can later be connected to these reinforcement elements.

To be able to transport a reinforced section designed according to the invention in a space-saving manner, it is preferable for the reinforcement elements to project, each with a connected segment, downward beyond the frame walls and to be connected by means of these connecting sections in a removable manner to the legs. The height of a section is thereby reduced by approximately one half during transport, so that much less space would be required for transport and with past designs of machine sections. The rigidity of the section is not affected by this design and by the attachment of the legs. Furthermore it is also possible to place two sections one above the other for transport.

Since the legs, by contrast with legs used until now, do not have to support any bearing profile of the section directly, a leg can be given a very simple configuration. According to the invention, the leg is therefore suitably made in the form of a multi-edge profile.

To increase rigidity of a machine section it, is advantageous for the structural units of the two longitudinal machine sides to be provided with connected elements in addition to the frame walls. It has been shown here to be advantageous for the connected elements to be located between the two structural units of the two longitudinal machine sides towards the top of at least one of the intermediate walls. Preferably at least one air-conducting channel is provided between the two structural units of the two longitudinal machine sides. Each of the structural elements is provided with a connection above and below this channel, of which at least one is present. It is especially advantageous in this case for the upper connection between the structural units of the two longitudinal machine sides to be placed substantially at the level of the winding mechanism and to be in the form of a receiving device for a bobbin evacuation system.

In a preferred further development of the instant invention, a bobbin evacuation system is provided with two conveyor belts between which diagonal braces extending in the longitudinal direction of the section are provided and connect each one of the horizontal connecting braces between the rails to at least one of the horizontal connections above the channel. In this manner, the rail system enhances the reinforcement of the section on the one hand. On the other hand, this affords the advantage that the bobbins of the two longitudinal machine sides can be conveyed independently of each other to the machine end, whereby the orientation of such bobbins can be linked to the fact whether a bobbin reaches the machine end via one or the other conveyor belt, so that an orderly depositing of the bobbins in a conveying carriage waiting at the machine end is possible.

It has been shown to be advantageous for the diagonal braces extending in the longitudinal direction of the section to be made substantially in the form of triangular plates in which one of the sides of is connected to a frame wall and the other side extends transversely over at least two of the connections located above the channel and is connected to same.

The rail system in itself can also be reinforced in a simple and advantageous manner by connecting the rails of the two longitudinal machine sides to each other, at least near the end walls, by means of rail connections, and by installing corner braces between the rails and the rail connections. These corner connections are advantageously made in the form of triangular plates (sheet steel corner plates), and it has been shown to be advantageous in this case for the plates constituting the corner connections to have a side that is substantially equal in length to the width of the spinning station.

The design of a section according to the instant invention affords the great advantage that a section can be made in aviation-type construction and can furthermore be transported in an assembled state without any danger of the sections becoming deformed during transport. The invention is simple in design and reliably ensures reinforcement of a section of an open-end spinning machine, so that adjustments once made are maintained permanently and thereby contribute considerably to reliable and constantly good spinning results. Readjustments after such transport or even after a long period of operation are therefore unnecessary.

Embodiments of the invention are explained below through drawings which are incorporated in and constitute a part of this specification, illustrate embodiments of the invention and, with the description, serve to explain the principles of the invention.

DETAILED DESCRIPTION OF THE PREFERRED EMBODIMENTS

Figure 1:
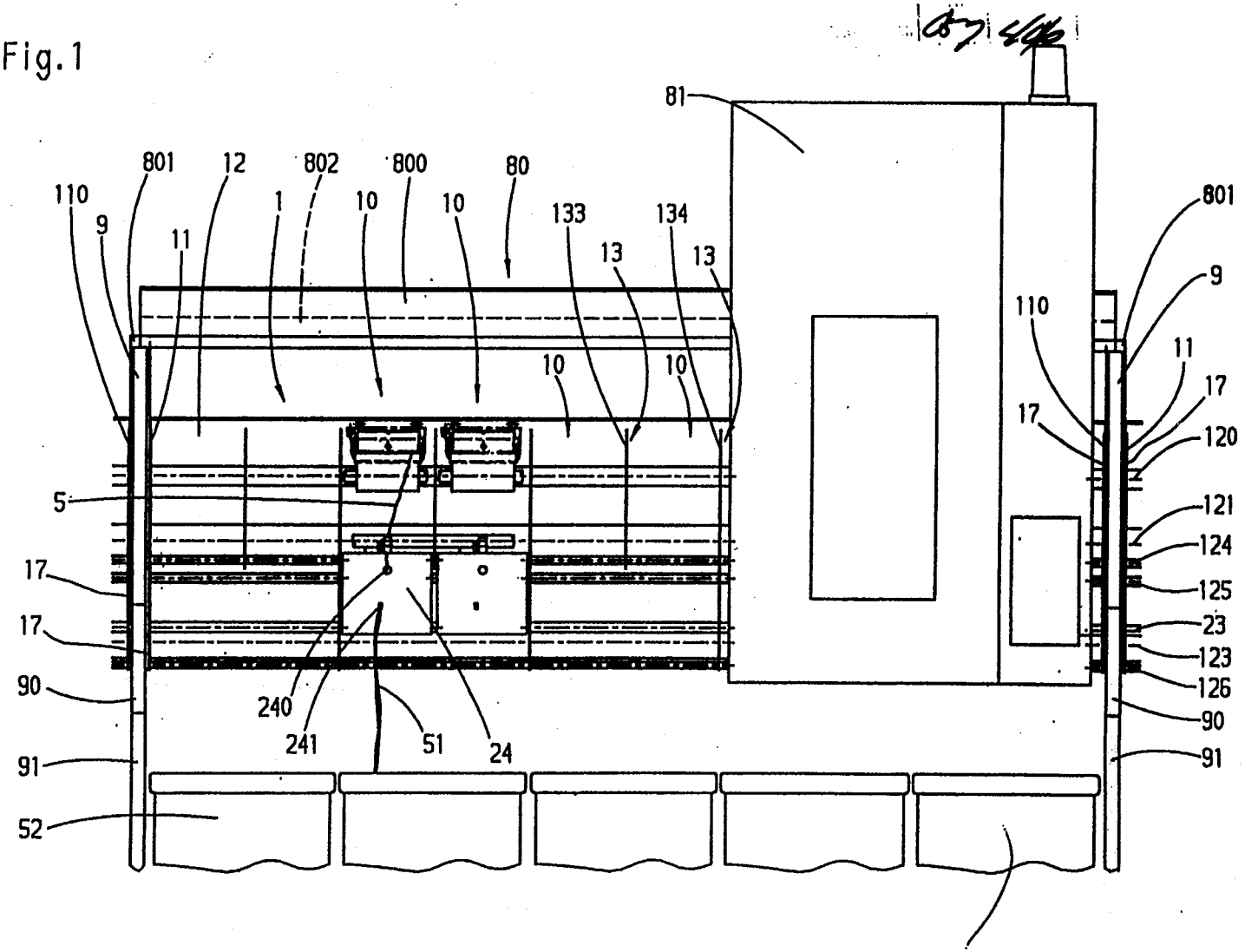
FIG. 1 shows a front view of a section of an open-end spinning machine according to invention.

Reference will now be made in detail to the presently preferred embodiments of the invention, one or more examples of which are illustrated in the accompanying drawings. Each example is provided by way of explanation of the invention, not limitation of the invention. The numbering of components in the drawings is consistent throughout the application, with the same components having the same number in each of the drawings.

The object of the invention will first be explained through the embodiments of an open-end spinning machine shown in FIGS. 1 and 2. Such a machine has, as a rule, a plurality of sections 1 which are placed next to each other, each with a plurality of spinning stations 10. Each section 1 is provided at each of its ends with an end wall 11 or 110 which is connected to the corresponding end wall 110 or 11 of an adjoining section 1.

The two end walls 11 and 110 of a section 1 are connected rigidly to each other by a plurality of longitudinal structural elements 12, 120, 121 and 123 to 127 (FIG. 2), e.g. by welding or screwing these longitudinal structural elements 12, 120, 121 and 123 to 127 to the end walls 11 and 110. Furthermore, intermediate walls 13 are provided in the embodiments shown between every two adjoining spinning stations 10. The intermediate walls 13 are connected to the longitudinal structural elements 12, 120, 121 and 123 to 127 or to several of these longitudinal structural elements 12, 120, 121 and 123 to 127. This connection between the intermediate walls 13 and the longitudinal structural elements 12 or 120, 121 and 123 to 127 is also of rigid design, and this can again be effected through screwing or welding.

Each spinning station 10 is provided with a group of technological spinning elements which are housed in different housings or structural units. For the sake of clarity such elements or their housing and structural units are shown only on two spinning stations 10, but it goes without saying that all the spinning stations 10 are of identical design. Since these housings and structural units, as well as the technological spinning elements contained therein, are not object of the instant invention they are shown only schematically in the figures. A housing 2 (FIG. 2) contains a conventional opener roller (not shown) which is driven via a belt drive 20 by a drive wheel 21 which is mounted on a drive shaft 22. The drive shaft 22 extends through an opening 130 in the intermediate wall 13 on which a bearing 131 supporting the drive shaft 22 is attached.

A further bearing 132 supporting a delivery roller 23 is attached to the intermediate wall 13.

Housing 2 is mounted in a detachable manner on the longitudinal structural element 126 and in addition bears upon longitudinal structural element 127, so that the housing 2 is secured by longitudinal structural element 127 against rotation in relation to the longitudinal structural element 126.

A housing 3 containing a spinning element (which is not shown) is furthermore mounted detachably on the longitudinal structural element 126. This housing is connected to a negative pressure source in a manner not shown here, as shall be explained in further detail later. Housing 3 bears with its end away from the longitudinal structural element 126 on longitudinal structural element 124 and is thereby also secured against swivelling around longitudinal structural element 126.

Also detachably mounted on longitudinal structural element 126, and also axially fixed, is a structural unit 4 which bears with its end away from longitudinal structural element 126 on a longitudinal structural element 125. This structural unit 4 receives the drive (in case of single drive) or at least part thereof, e.g. in form of supporting disks 40. Shaft 30 of a spinning element (not shown) that could be made in form of a spinning rotor is located in the nip of the supporting disks 40.

A drive belt 41 which extends over the entire machine length is connected to this shaft 30. When the spinning element is to be stopped, the drive belt 41 can be lifted off from shaft 30 of the spinning element in a known manner which is therefore not shown. The two housings 2 and 3, as well as the structural unit 4, are axially fixed on a common longitudinal structural element 126 formed as a round support and are thereby also aligned with each other. The housings 2 and 3 as well as the structural unit 4 are secured against rotation by the longitudinal structural elements 124, 125, 126 and 127, which are also in the form of round supports.

A cover 24, with which the two housings 2 and 3 can be covered, is mounted on housing 2. This cover 24 contains at least part of a fiber feeding channel (not shown) through which fibers can be fed from housing 2 into housing 3 to the spinning element contained therein. Upon integration of these fibers into a new yarn 5 the latter leaves the housing 3 through a yarn draw-off channel 240 located in the cover 24.

Above the longitudinal structural element 124, the intermediate wall 13 supports a bearing 14 of a draw-off shaft 140 which extends over the entire length of section 1. One pressure roller 141 per spinning station 10 mounted pivotably in a manner not shown interacts with shaft 140.

Above the draw-off roller 141, the intermediate wall 13 supports a second bearing 15 of a winding roller 150 which also extends over the entire length of section 1. During operation, a bobbin 50 being wound and held between two bobbin arms 151 in such manner as to be capable of being replaced lies on this winding roller 150. The bobbin arms 151 are supported pivotably by a bearing 152 which is attached to the longitudinal structural element 12.

Figure 3:
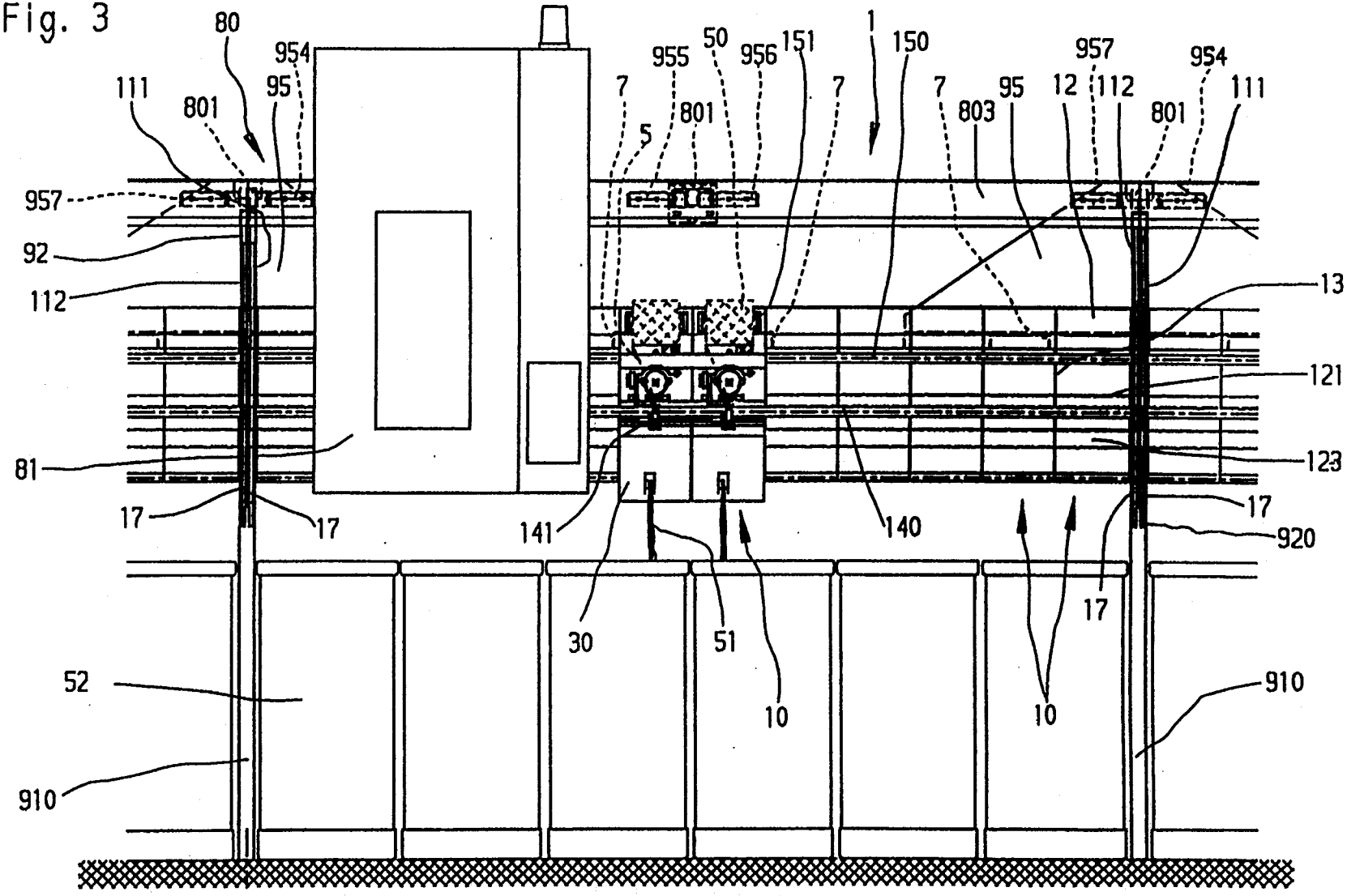
FIG. 3 shows a schematic front view of a modified embodiment of a machine section according to the invention.

In principle, elements of any desired design, e.g. two parallel shafts, can be provided to support the winding mechanism. A design in the form of a profiled rail, e.g. Z-shaped has proven to be especially advantageous for non-rotatable seating of the winding mechanism and for the suspension of other machine parts and mechanisms. This profiled rail is connected to the two upper ends of the intermediate walls 13 facing each other of a longitudinal machine side as shown in FIG. 3.

Figure 2:
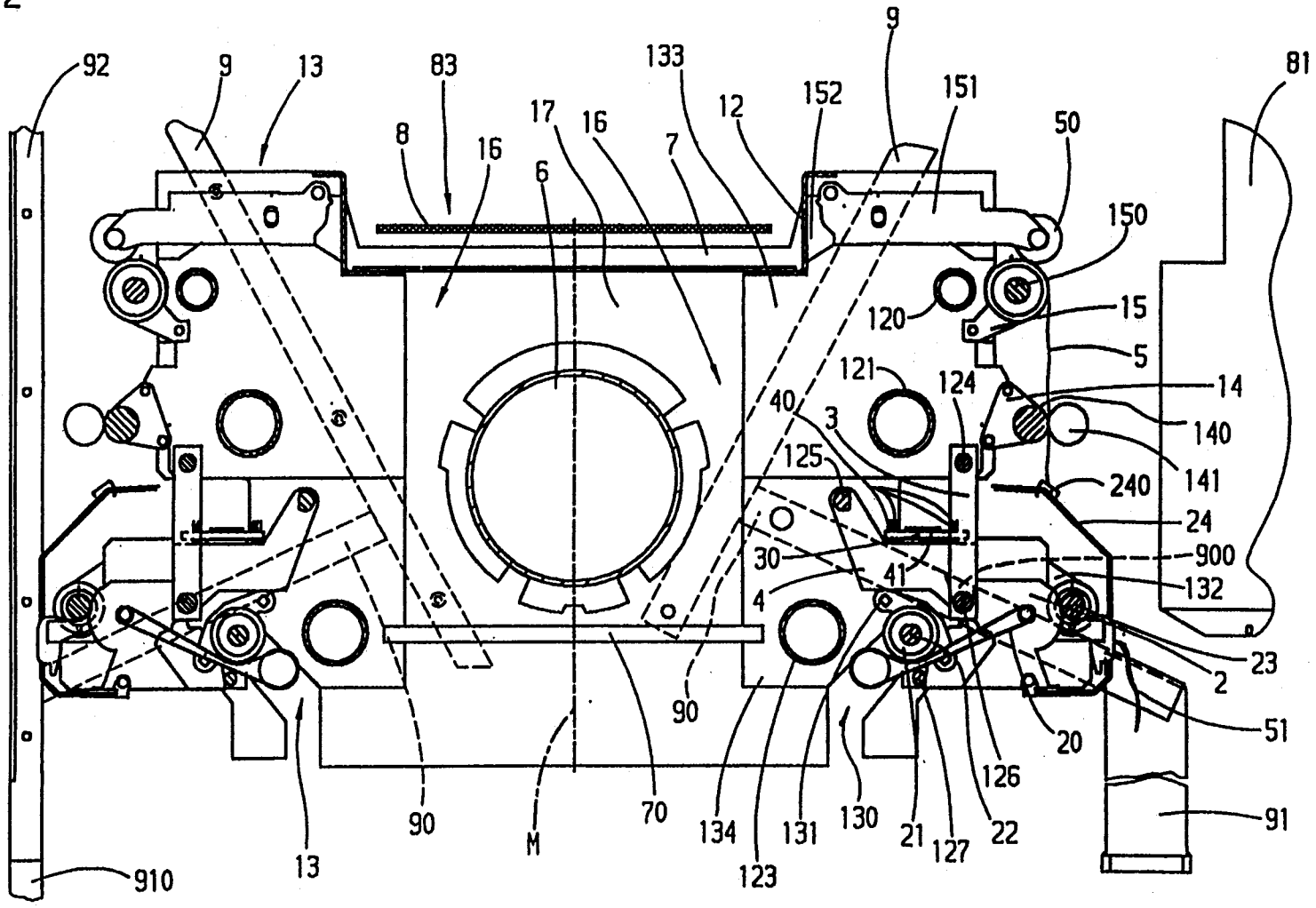
FIG. 2 shows a cross-section through the open-end spinning machine shown in FIG. 1, in two different versions.

As can be seen in FIGS. 1 and 2, a fiber sliver 51 taken from a chamber is fed to housing 2 through a feed opening 241 in the cover 24. The fiber sliver is fed by delivery roller 23 and a counter-element interacting with it (e.g. feeding tray, not shown) of an opener roller (not shown) in order to be opened. The fibers detached by this opener roller from the forward end of fiber sliver 51 are fed in an opened state through a fiber feeding channel (not shown in the drawings) to the spinning element located in housing 3 where they are integrated into the end of yarn 5. Yarn 5 is drawn off by means of draw-off roller 140 and pressure roller 141 and is drawn through yarn draw-off channel 240 out of housing 3 and is fed to the bobbin 50 where yarn 5 is wound up.

The technological spinning elements must be adjusted and aligned very precisely with respect to each other in operation to be able to yield optimal spinning results. At the same time, adjustments once made should be maintained permanently and may not change either during transport from manufacturer to customer or over a long period of operation. The described design of each side of a section 1 in the form of a rigid structural unit 15 serves this purpose. As is also described, the rigid structure of the structural unit 16 is achieved in that the end walls 11, 110 are connected to each other by a plurality of longitudinal structural elements 12 and 120, 121 and 123 to 127, which are in turn connected to each other by intermediate walls 13, or at least a major part of them are thus interconnected.

The end walls 11, 110 of the two structural units 16 of a section 1 are connected to each other in pairs by means of frame walls 17. The frame walls 17 are designed so that they still leave sufficient space between the structural units 16 for the central units which are jointly assigned to the two structural units 16 to find room.

The described device can be varied in many different ways, e.g. by replacing individual elements by equivalents or through different combinations thereof. Thus, it is not absolutely necessary for an intermediate wall 13 to be provided between the spinning stations 10 of each pair of spinning stations. It is possible to provide such intermediate walls 13 merely between two adjoining pairs of spinning stations. Since the distance between this intermediate wall 13 located after each pair of spinning stations and the adjoining intermediate wall 13 is as a rule not very great, the intermediate walls 13 permanently ensure the parallel course of the longitudinal structural element 12, 129, 121 and 123 to 127 contained therein. Furthermore, the longitudinal structural elements 12, 120, 121 and 123 to 127 designed as round supports serve as reinforcements not only in the longitudinal direction of the machine but also in its transversal direction. This transversal reinforcement is especially effective thanks to the longitudinal structural elements 120, 121 and 123 which are in the form of pipes in the embodiment shown and are therefore especially resistant to sagging and twisting.

As shown in FIGS. 1 and 2, it is not required for all the intermediate walls 13 to be identical in design when these are provided between all adjoining spinning stations 10. Thus the shown embodiment provides for every second intermediate wall 133 to extend from the area with the longitudinal bearings of the structural element 12 supporting the bobbin arms 151 downward to the longitudinal structural element 124 to which housing 3 is attached. The intermediate walls 134 installed between the intermediate walls 133, and thereby after every other spinning station 10, extend on the other hand from longitudinal structural element 12 down to longitudinal structural element 127.

A design of this type with alternating short intermediate walls 133 and long intermediate walls 134 will suffice. For reason of standardization of parts of the machine and to increase the rigidity of each structural unit 16, it is however especially advantageous for all the intermediate walls 13 to be of identical design and to extend over the height of the intermediate walls 134, i.e. from the longitudinal structural element 12 bearing the winding mechanism (bearing 152 of the bobbin arms 151) to the longitudinal structural elements 124, 125, 126 and 127 with the technological spinning elements.

In the described embodiment, the groups of technological spinning elements (housing 2 and 3, structural unit 4) are mounted on the longitudinal structural elements 124, 125, 126, 127. This is however not a precondition. It is also possible to mount the groups of technological spinning elements or part thereof on the intermediate walls 13.

In the shown embodiment, the shafts or rollers 22, 23, 240 and 150 are mounted by means of bearings 131, 132, 14 and 15 to the intermediate walls 13. In this manner it is possible to omit separate supports which would be installed on any of the longitudinal structural elements 120, 121, 123, 124, 128 or 127.

While angle profiles or similar devices which must be relatively thick are conventionally used to support the technological spinning elements (housings 2 and 3 of structural unit 4), round supports are used as a rule as supporting elements of these parts in the shown embodiment. In this manner, it is possible to use aviation-type construction while good reinforcement of the structural unit 16 is ensured.

In the modern open-end spinning machines two identical longitudinal machine sides are provided, each with an equal number of spinning stations 10. Each of these longitudinal machine sides is designed in the manner described as a separate structural unit 16, but for reasons of clarity only the technological spinning elements and the winding mechanism in the structural unit 16 shown on the right of FIG. 2 are shown. It goes however without saying that the structural unit 16 shown on the left is designed in the same, i.e., symmetrical, manner as the structural unit 16 on the right, To ensure that these elements also maintain their relative positions without change during transport and subsequent operation, the two structural units 16 of the two longitudinal machine sides of section 1 are rigidly connected to each other.

This interconnection of the two structural units 16 can be effected in principle in different manners, e.g. by means of frame walls 17 extending over the entire width of the machine. In addition intermediate walls (not shown) extending over the entire machine width can be provided. It may however suffice, in order to connect the structural units 16 of the two longitudinal machine sides, if, in addition to the frame walls 17, at least one of the intermediate walls 13 (over the longitudinal structural elements 12) of the two structural units 16 of a section 1 is connected in the upper ranges to the other (connection 7).

The manufacture of separate structural units 16 for the two machine sides and their connection by means of frame walls 17 and/or connecting elements (connection 7) has the advantage that without changing the design of the structural units 16, these can also be used if the central elements provided between the structural elements 16, i.e. those provided jointly for both structural units 16, should change.

In the lower ranges it suffices if a reinforcement (connection 70) is provided at a right angle to the long side of section 1 near the end walls 11 and 110. It is also entirely possible to connect in addition one or several of the intermediate walls 13 or 133 or 134 of the two longitudinal machine sides with each other by means of such a reinforcement element.

In FIG. 2 provisions are made for an air-conducting channel 6 to extend in the longitudinal direction of the machine at the center in each section 1 and to be connected to the two end walls 11 and 110 of section 1. In this manner, this channel 6 also contributes to a reinforcement in all planes of the machine frame. Housing 3 is connected to this channel 6 in a manner not shown, so that the under-pressure required for spinning is produced in it.

In the described and shown embodiment the connections 7 are provided above channel 6, essentially in the plane of the adjoining intermediate walls 13 or 133 or 134 at the level of every second one of these intermediate walls 13. The upper connections can thereby serve to support a bobbin evacuation system in form of a conveyor belt 8.

As shown in FIG. 1, the sections are delimited by frame walls 17 which extend from one longitudinal machine side to the other and connect the two structural units 16 with each other. These frame walls 17 are generally made of sheet metal in order to make the machine sections, and thereby also the machine, as light as possible. In order to reinforce these frame walls 17 they are angled their edges in a manner not shown here. In addition, reinforcement elements 9 extend in the shown embodiments across the frame walls 17 in the area of each structural unit 16. A connecting element 90 ending in a leg 91 is connected to each reinforcement element (FIG. 2, right side). This connecting element 90 also serves as a reinforcement element and can even be installed so that it receives and thus supports one of the main longitudinal structural elements, e.g. the longitudinal structural element 126 with the technological spinning elements.

As shown in FIG. 2, the reinforcement element 9 is placed at an angle on the frame wall 17 so that it extends between the winding roller 150 or the longitudinal structural element 120 and bearing 152 or longitudinal structural element 12, while its lower end approaches the machine center M insofar as this is possible in view of the channel 6 located at that point.

If a rail system 80 for a service carriage 81 travelling alongside the machine is provided, the reinforcement element 9 extends up to the rail system 80. The latter has one rail 800 or 803 per longitudinal machine side (see FIG. 4), the rails 800 and 803 being connected to each other by means of connecting braces 801 at least in the area of the end walls 11 and 110, but it is advantageous to provide an additional connecting brace 801 between the end walls. An additional rail 802 or 804 (see FIG. 4) is provided on each of these connecting braces 801, parallel to the rails 800 and 803 and always at the same defined distance therefrom (see FIG. 4). Each of the pairs of rails consisting of rails 800 and 802 or 803 and 804 is provided to support the service carriage(s) 81 and supports wheels 810, 811, 812 and 813 of the service carriage 81 in a suitable manner.

The rails 800, 802, 804, 803 are connected in a suitable manner, e.g. through welding or screwing, to the connecting braces 801 located near the side walls 11, 110, and which are rigidly connected to their respectively assigned side walls 11, 110.

As FIG. 1 shows, the reinforcement elements 9 and 90, as well as the legs 91, are each located between two sections 1 and serve in their assembled state to reinforce the frame walls 17 of two adjoining sections 1. The rails 800 and 802 are of such length that they end essentially at the center on the reinforcement elements 9 on the two ends of section 1, so that rails 800 can be mounted on the reinforcement elements 9 and the rails 802 on the connecting braces 801.

For transport of the end stocks of the machine, as well as of their individual sections 1, from the manufacturer to the customer, every second section 1 is assembled in the manner shown in FIG. 1, while the sections in between have neither reinforcement elements 9 and 90 nor legs 91. For this reason the sections 1 shipped without the reinforcement elements 9 and 90 and legs 91 can also not support any connecting braces 801 and rails 802.

The legs 91 are assembled only at the customer's plant, i.e. after shipping. As a result, the sections 1 are relatively low during transport. This makes it possible to stack two sections la and 1b one over the other during transport, so that transport is very space-saving (see FIG. 6).

Figure 6:
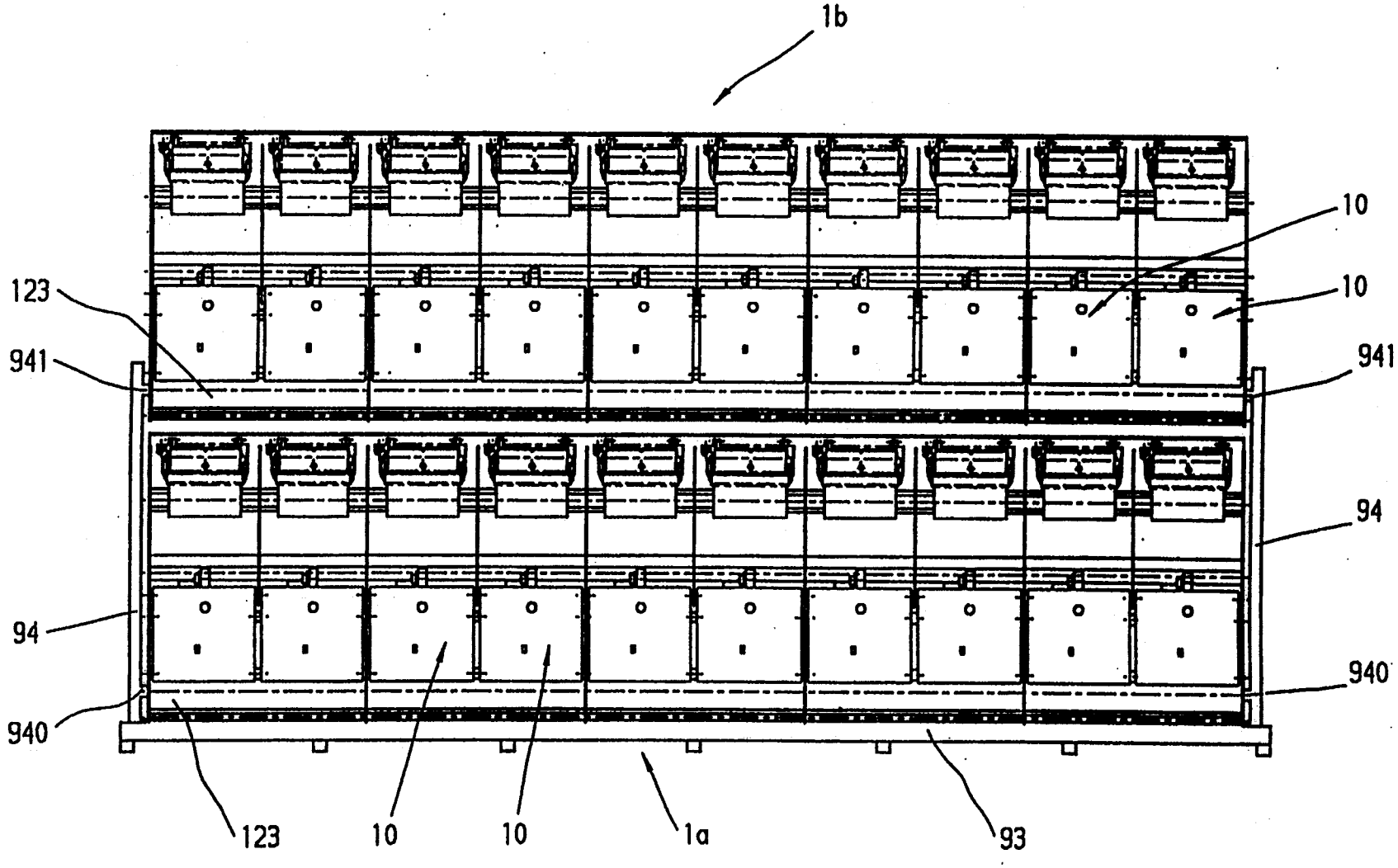
FIG. 6 shows two sections according to the invention of an open-end spinning machine stacked one above the other.

FIG. 6 shows two sections 1*a* and 1*b* without reinforcement elements 9 which, as stated above, are provided in a complete, assembled state between every two sections 1 with reinforcement elements 9 on both sides. The lower section 1*a* of the two sections 1*a* and 1*b* is standing on a skid 93 and is supported by same over its entire length and its entire width. At each end of the skid 93 a supporting frame 94 is provided which is equipped with two bearing lugs at the same height (one per structural unit 16), and which go into the ends of the tubular longitudinal structural elements 123 to provide additional support of sections 1*a*.

The supporting frame 94 has furthermore two bearing lugs 941 at the same level which engage the ends of the tubular longitudinal structural elements 123 of the upper section 1 and hold the latter at a distance above the other section 1.

The tubular longitudinal structural elements 123 of the two structural units 16 thus serve as temporary supports of transport axles which are constituted in the embodiment shown by a pair of transport lugs 940 or 941. It is however also possible to introduce rods (serving as transport axles) into the tubular longitudinal structural elements 123, whereby a handling device (crane or supporting scaffold similar to supporting frame 94) can engage the ends of said longitudinal structural elements 123.

At the manufacturer's plant each section 1 which is to be placed at an even-numbered position in the finished and assembled machine is provided with reinforcement elements 9 and 90 on its outside. These sections 1 to be placed at even-numbered positions are adjusted precisely by the manufacturer. The missing intermediate sections which are also pre-adjusted and are not provided with any reinforcement elements 9 and 90 and with no legs 91 are then assembled at the customer's plant, they are connected to the reinforcement elements 9 and 90 of the sections 1 placed at the even-numbered positions and the legs 91 are installed. The rails 800 and 802 of the two longitudinal machine sides then merely need to be set on the reinforcement elements 9 located between the sections 1 and on the connecting braces 801 without time-consuming adjustment being again required.

In FIG. 2 two different embodiments are shown on the right and on the left, and these are of course not used simultaneously in one machine but are used alternately. As the left side of FIG. 2 shows, vertical support elements 92 are provided between the legs 910 and the rail system 80, constituting direct vertical connections between said rail system 80 and said legs 910. In this manner the forces exerted by the rail system 80 need not first be diverted over the reinforcement elements 9 and 90 but are bearing directly upon the leg 910. As can be seen in FIG. 1, the reinforcement elements 9 (and of course the support element 92) are directly connected to the rail system 80.

Depending on the design of the reinforcement elements 9 and 90 and of the support elements 92, these can render the frame walls 17 superfluous and can themselves take over their task. However, additional frame walls provide especially good rigidity of the machine without having to make the reinforcement elements 9 and 90 and the support elements 92 excessively thick.

To increase the rigidity of a section 1 the reinforcement elements 9 and 90 of a section end are not only connected to each other via the frame wall 17 but are directly connected to each other (see FIG. 2).

As shown in FIG. 2, openings 900 are provided in the embodiment shown at the top of the slanted connecting elements 90. As mentioned earlier, the connecting elements 90 are provided only on every other section 1. On the sections located between these sections 1 equipped with connecting elements 90, the longitudinal structural elements 126 extend outward beyond the frame walls 17, i.e. beyond the end of section 1 to such an extent that they can be introduced from above into the openings 900 in the connecting elements 90 of the adjoining sections 1 by lowering said section 1. In this manner adjoining sections 1 are precisely aligned with each other.

FIG. 3 shows a variant of the described open-end spinning machine which, in addition to its end stocks (not shown) is also provided with a plurality of sections 1, of which only one such section 1 is shown.

Of the plurality of longitudinal structural elements extending in the longitudinal direction of section 1, FIG. 2 only shows two longitudinal structural elements 121 and 123 in form of reinforcement pipes as an example, as well as a longitudinal structural element 12 designed as a Z-shaped support. In this embodiment too, intermediate walls 13 are provided (as described through FIGS. 1 and 2) which are rigidly connected to the longitudinal structural elements 12, 121, 123 and other longitudinal structural elements (not shown).

The technological spinning elements of each spinning station 10 are covered by a cover 30. For reason of clarity such technological spinning elements and their covers 31 etc. are again shown only in two spinning stations 10, but it goes without saying that all the spinning stations 10 are identical.

In this embodiment the end walls 111 and 112 not only reach as high as the intermediate walls 13 which extend over the technological spinning elements including the bearing of the bobbin arms 151 on the longitudinal structural element 12, but reach further to the level of the rail system 80 of the service carriage 81 which travels alongside the machine, i.e. alongside the spinning stations 10 of the individual sections 1 in order to carry out service tasks at the different spinning stations 10 as required, e.g. piecing after a stoppage of the machine or of an individual spinning station 10 or replacement of a full bobbin 50 by an empty sleeve, etc.

The rail system 80 consisting of rails 800, 802, 804, 803 and connecting braces 801 is supported by vertical supporting elements 92 (see also left side of FIG. 2) which are rigidly connected to the end walls 111, 112 and extend by connecting segment 920 beyond the underside of these end walls 111, 112. The elements 92 are screwed to the upper ends of the legs 910 which are of sufficient height so that cans 52 from which the fiber material to be spun is taken in the form of fiber slivers 51 and fed to the delivery and opener devices located in housings 3 can be placed below the intermediate walls.

In addition to the vertical supporting elements 92, reinforcement elements 9 are provided near the end walls 111 and 112. Elements 9 are connected to the end walls 111 or 112 at their upper ends to the connecting braces 801 and/or the supporting elements 92. The reinforcement elements 9 extend into the proximity of the lower edge of the end walls 111, 112 and are oriented in the direction of machine center M.

Through rigid connection of the end walls 111, 112 to the reinforcement elements 9 on the one hand and to the longitudinal structural elements 12, 131, 134 and additional longitudinal structural elements (not shown in FIG. 4) and through these to the intermediate walls 13 on the other hand, the technological spinning elements are also held indirectly in their relative positions by the rail system 80, since the end walls 111 and 112 are suspended to a certain degree via reinforcement elements 9 from the connecting braces 801. The bracing elements 9 produce considerable reinforcement of section 1, so that the latter maintains its desired shape and does not become twisted even during transport.

At the center of the machine, in the longitudinal direction of section 1, an air-conducting channel 6, to which the housings 3 containing the spinning elements are connected via suction circuits 60, extends so that the required negative spinning pressure is produced in said housings 3. The air-conducting channel 6 is rigidly connected to the frame wall 17 of section 1.

The forces which are diverted by the rail system 80 to the reinforcement elements 9, and from these to the end walls 111 and 112, are also absorbed by the connections 7 between the longitudinal structural element 12, which can be provided not only near the end walls 111 and 112 but also in between.

In principle it would be possible to dispense with the connections 7 in view of the presence of the reinforcement elements 9, but the connections 7 provided between the end walls 111 and 112, especially when the end walls 111 and 112 are made of sheet metal, provide additional reinforcement of section 1.

Figure 4:
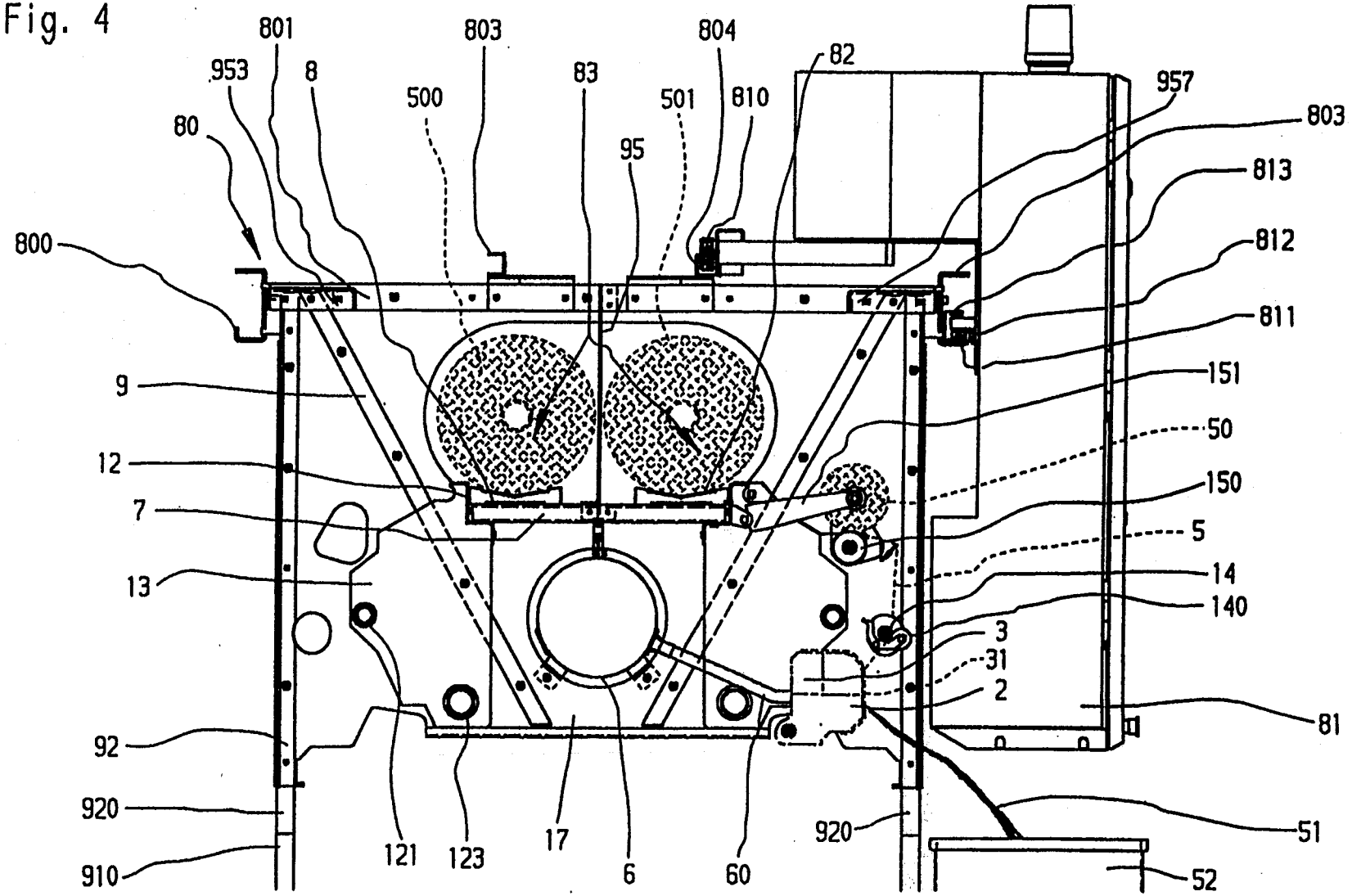
FIG. 4 shows a cross-section through the machine section shown in FIG. 3.

The horizontal connections 7 are also placed essentially at the level of the winding mechanisms (12, 150, 151, 50) according to FIG. 4 and serve to receive a bobbin evacuation system 83 which is substantially in form of a conveyor belt for one machine side and a conveyor belt 82 for the other machine side. FIG. 4 depicts a bobbin 500 or 501 on each of these conveyor belts 8, 82, it being possible for each bobbin to be conveyed by the corresponding conveyor belt 8 or 82 to a conveying carriage (not shown) at one machine end.

The design of the bobbin evacuation system in the form of two conveyor belts 8 and 82 has the advantage over a design with only one single common conveyor belt (as in FIG. 2) for both longitudinal machine sides in that additional supporting elements can be provided between the conveyor belts 8 and 82. As FIG. 5 clearly shows, several connections 7 are provided for that purpose near the frame wall 17, between the longitudinal structural elements 12 in the plane of each intermediate wall 13. One of the sides of a right-angled triangular plate 95 (steel sheet corner plate) is connected to these connections 7 while the other side is connected to the connecting brace 801. This plate 95 thus supports the longitudinal structural elements 12 via connections 7 and also the intermediate walls 13 through them. In this manner, the rail system 80 also indirectly supports the technological spinning elements which are either attached to longitudinal structural elements which are in turn secured in their relative positions by intermediate walls 13, or which are attached directly to the intermediate walls 13. In the shown embodiment four connections 7 are connected to this plate 95, but the number of connections 7 with which plate 95 is connected does not play a major role. Thus for instance the plates 95 (steel sheet corner plates) can be connected with only two, but also with more than four connections 7.

As shown in FIGS. 1 and 3, at least one or several more connection(s) 7 are provided also in the longitudinal zone of section 1 between the plates 95 in order to reinforce section 1.

It is not necessary to provide triangular plates 95 as cross braces between the connecting braces 801 and the connections 7. Cross braces in some other form, e.g. in form of rails, can be used instead of the plates 95 (sheet steel corner plates) if this were to prove advantageous because the cross braces may have to serve yet another purpose besides reinforcement. It may be sufficient here under certain circumstances for such cross braces to be connected in addition to connecting brace 801 only to one single connection 7.

Figure 5:
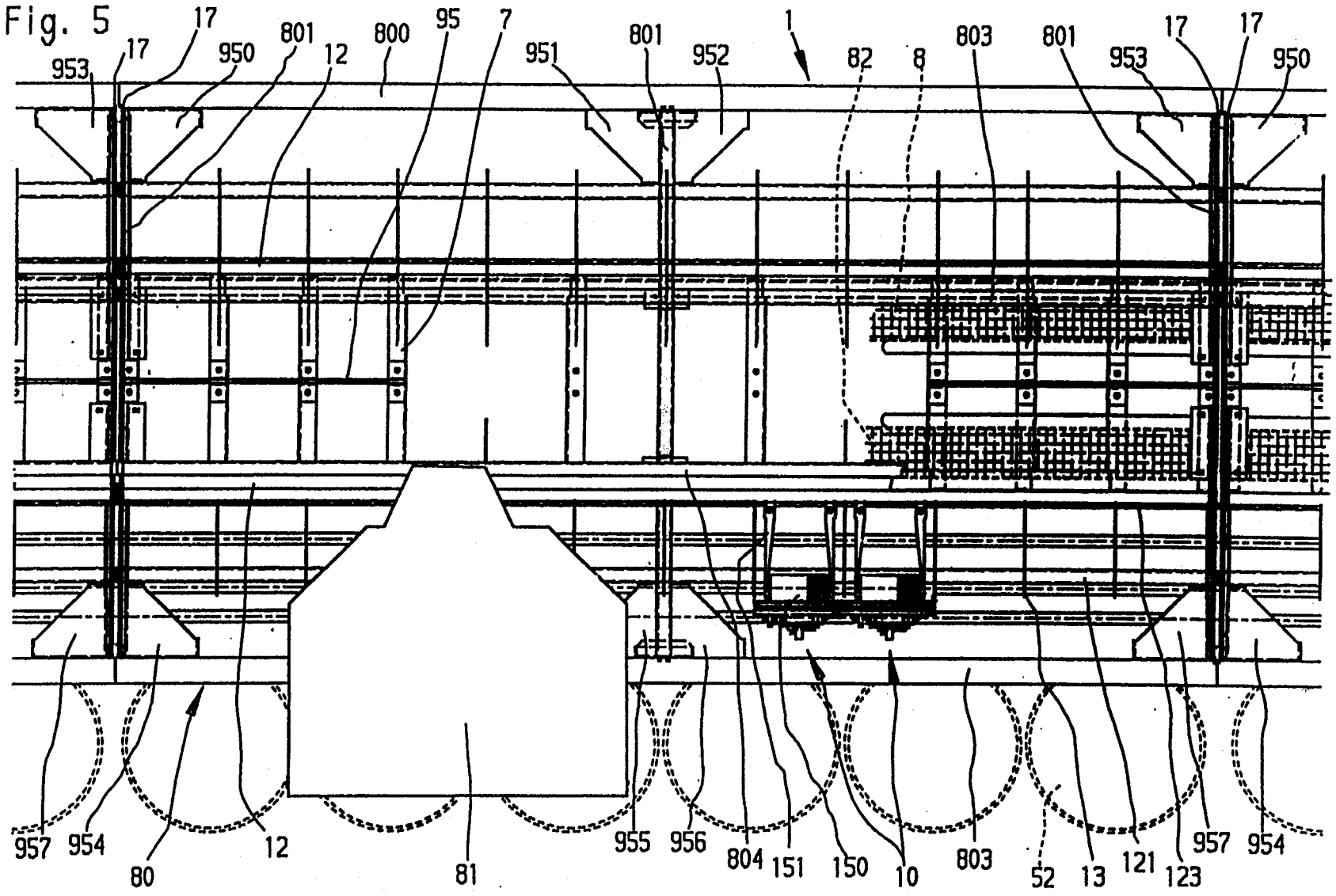
FIG. 5 shows a top view of the sections of an open-end spinning machine shown in FIGS. 3 and 4.

In order to tie up the connections of the frame securely, triangular plates 950 to 957 are provided in the embodiment of FIG. 5 as corner braces in the corners between the rails 800 or 803 and the connecting braces 801.

It goes without saying that the corner braces can have in principle any configuration desired and are not bound to the triangular form. These corner braces can furthermore be omitted if sufficient rigidity of the rail system 80 is ensured in some other way, e.g. by making the connecting braces 801 sufficiently wide, etc.

If the corner braces are made in the form of triangular plates (steel sheet corner plates), a width that is substantially equal to the width of a spinning station 10 has proven to be especially advantageous since the plates are not too heavy on the one hand, but lend a high degree of rigidity on the other hand.

As mentioned, it is not absolutely necessary to provide intermediate walls 13 between the individual spinning stations 10 if other measures (other cross braces instead of the intermediate walls 13, especially strong longitudinal structural elements for the technological spinning elements, etc.) ensure that these elements cannot change their relative positions. In this case, suspending the end walls 111 and 112 on the reinforcement elements 9 for permanent positioning of the technological spinning elements is sufficient. If the bobbin arms 151 are not attached to the intermediate walls 13 in the manner described, but are attached to the longitudinal structural elements 12 which extend over the entire section 1, this positive effect upon positioning of the technological spinning elements is further enhanced.

In the described embodiment of section 1, the vertical support elements 92 extend beyond the end walls 11 and 12 downward with a connecting segment 920, so that the legs 910 can be connected directly to the supporting elements 92 (so that they can be removed) via this connecting segment 920. In this manner, the pressure forces exerted by the rail system 80 upon the supporting elements 92 are diverted directly into the legs 910. Access to the connection point (connection segment 920) between supporting element 92 and leg 910 is made especially easy thanks to the extension of the supporting elements 92 beyond the end walls 111 and 112 downward in a preferred embodiment, thus facilitating assembly. In addition the end walls 111, 112 need not be taken into consideration in designing the form of the legs. Thus it is possible to provide legs constituted by a multi-edge profile rather than to use heavy flat legs.

Customarily, separate legs 910 per each section 1 are provided at each section end. Since the legs 910 in the described embodiment can easily be mounted later, provisions are made according to FIG. 3 for each leg 910 to be assigned to two adjoining sections 1 in common. Leg 910 is therefore as wide as two adjoining end walls 111 and 112, two frame walls 17 and one supporting element 92 and is connected in its assembled state to the vertical supporting element 92 between two frame walls 17 of two adjoining sections 1.

Easy accessibility of the connecting points between supporting elements 92 and legs 910 also offers the possibility of delivering the machine from manufacturer to customer in a space-saving manner. Since the legs 910 can be removed for transport, each section 1 is reduced in height by the height of the leg, and this saves considerable space and, therefore, transport costs, over conventional configurations. These sections can also be stacked one above the other for transport, as shown in FIGS. 3 to 5 in the manner shown in FIG. 6.

It will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents.

We claim:

1. An open-end spinning machine having at least one section comprising a rigid machine frame structural unit along at least one side thereof, each said rigid machine frame structural unit having:

end walls disposed at the ends thereof;

adjacent spinning stations arranged between said end walls, each said spinning station having:

individually mounted spinning elements, including:

an individual rotor housing having a spinning rotor housed therein;

drive unit parts provided to drive said spinning rotor; and an individual opener housing having an opener roller for opening a fiber sliver into individual fibers;

said spinning station further having a winding mechanism;

a plurality of individual and substantially parallel longitudinal structural elements disposed between said end walls and rigidly connected to said end walls;

intermediate walls disposed between said end walls between every adjoining pair of said spinning stations, said intermediate walls being rigidly connected to said structural elements, said longitudinal structural elements passing through said intermediate walls so as to be surrounded by said intermediate walls and being rigidly connected thereto;

said spinning elements being positionally fixed relative to each other along at least two of said longitudinal structural elements and supported by said longitudinal structural elements; and said winding mechanism being arranged above said spinning elements and supported by at least one of said longitudinal structural elements.

2. The machine as in claim 1, wherein said spinning elements of said spinning stations are connected to said longitudinal structural elements.

3. The machine as in claim 1, wherein said spinning elements of said spinning stations are connected to said intermediate wall adjacent said spinning station.

4. The machine as in claim 1, wherein said spinning elements of said spinning stations are connected to said longitudinal structural elements and said intermediate wall adjacent said spinning station.

5. The machine as in claim 1, wherein each longitudinal side of said machine comprises a plurality of said sections arranged end-to-end along said longitudinal side, the adjacent said end walls of said end-to-end structural units being interconnected by a frame wall disposed between said adjacent end walls, said end walls connected to said frame wall.

6. The machine as in claim 5, wherein said structural units on opposite longitudinal sides of said machine have common said end walls, said common end walls extending from one longitudinal side of said machine to the other.

7. The machine as in claim 5, wherein every alternating said section along each longitudinal side of said machine comprises at least one said longitudinal structural element extending beyond said end walls of said structural unit and through said frame wall, and wherein every other alternating section comprises an opening in each said end wall for receiving said longitudinal structural element extending through said frame wall.

8. The machine as in claim 1, further comprising opposing said sections on opposite longitudinal sides of the machine, said opposing sections connected together through connecting segments, said connecting segments being connected to said end walls of said opposing structural units.

9. The machine as in claim 8, wherein at least one of said connecting segments is disposed essentially at the level of said winding mechanisms of said spinning stations and is configured to receive a bobbin evacuation system.

10. The machine as in claim 1, wherein said intermediate walls are disposed transverse relative said longitudinal structure elements and extend generally to a location adjacent said longitudinal structural elements supporting said winding mechanisms.

11. The machine as in claim 1, wherein said intermediate walls are disposed transverse relative said longitudinal structural elements and extend generally beyond said longitudinal structural elements supporting said winding mechanisms.

12. The machine as in claim 1, wherein said intermediate walls extend generally beyond said longitudinal structural elements supporting said winding mechanisms and beyond said longitudinal structural elements supporting said drive unit parts.

13. The machine as in claim 1, further comprising bearing devices connected to said intermediate walls for supporting drive shafts extending through said intermediate walls.

14. The machine as in claim 1, wherein one of said longitudinal support elements comprises a shaped profile on which a pair of bobbin arms in mounted per each said spinning station.

15. The machine as in claim 1, wherein said longitudinal support elements supporting said drive unit parts and said winding mechanisms comprise substantially round supports.

16. The machine as in claim 1, wherein said drive unit parts of said spinning stations are mounted in a detachable manner on a first common longitudinal support element and secured against relative rotation by a second common said longitudinal support element.

17. The machine as in claim 1, wherein at least one of said longitudinal support elements comprises a tubular element configured for receiving a transport axle therethrough for aiding in transporting said machine.

18. The machine as in claim 1, wherein said end walls are formed of sheet metal, and further comprising at least one separate reinforcing element connected to each said end wall of said structural unit.

19. The machine as in claim 18, further comprising legs supporting each said structural unit, and connecting elements connecting said legs to said reinforcing elements.

20. The machine as in claim 19, wherein said legs comprise multi-edge profiles.

21. The machine as in claim 18, further comprising a plurality of said reinforcing elements at each end of said structural unit, said reinforcing elements connected to each other and to said respective end wall.

22. The machine as in claim 18, wherein opposing said sections on opposite longitudinal sides of said machine are connected together through connecting segments, said connecting segments being connected to said reinforcing elements of opposing said structural units.

23. The machine as in claim 22, further comprising an air conducting channel disposed between said opposing structural units, said connecting segments being disposed above and below said air conducting channel.

24. The machine as in claim 22, wherein at lest one of said connecting segments is disposed essentially at the vertical level of said winding mechanisms of said spinning stations and is configured to receive a bobbin evacuation system.

25. The machine as in claim 24, further comprising a brace extending longitudinally between said structural units generally dividing said connecting segment disposed at the vertical level of said winding mechanisms, said bobbin evacuation system comprising at least one conveyor belt for each said structural unit, said conveyor belts running longitudinally along said connecting segment on each side of said brace.

26. The machine as in claim 25, further comprising a rail system for supporting a service carriage disposed to travel along the longitudinal sides of said machine, said rail system comprising a rail disposed above said winding mechanisms and connected to and supported by said reinforcing elements so as to extend continuously along each longitudinal side of said machine, and further comprising at least one horizontal brace connecting said rails at each end of said structural unit, said horizontal braces connected to said reinforcing elements and to said connecting segment disposed at the vertical level of said winding mechanisms through said brace.

27. The machine as in claim 26, further comprising corner braces at a junction of said rails and said reinforcing elements.

28. The machine as in claim 27, wherein said corner braces comprise triangular braces.

29. The machine as in claim 18, wherein opposing said sections on opposite longitudinal sides of said machine are connected together through a common frame wall.

30. The machine as in claim 1, further comprising a rail system for supporting a service carriage disposed to travel along the longitudinal sides of said machine, said rail system comprising a rail disposed above said winding mechanisms and connected to and supported by said reinforcing elements so as to extend continuously along each longitudinal side of said machine.

31. The machine as in claim 30, further comprising legs supporting each said structural unit and connecting elements between said rail system and said legs.

* * * * *